US005546877A

United States Patent [19]

Moore

[11] Patent Number: 5,546,877

[45] Date of Patent: Aug. 20, 1996

[54] FABRIC SECURING DEVICE INCLUDING ADHESIVE AND NEEDLE LUBRICATION

[75] Inventor: Leo M. Moore, Richmond, Va.

[73] Assignee: Mutual Holdings Inc., Richmond, Va.

[21] Appl. No.: 258,052

[22] Filed: Jun. 10, 1994

[51] Int. Cl.[6] ..... D05B 39/00; D05B 71/00

[52] U.S. Cl. ..... 112/103; 112/256

[58] Field of Search ..... 112/114, 119, 112/470.09, 470.14, 475.18, 98, 99, 102, 103, 43; 156/93; 248/362, 205.3, 205.5, 206.3; 184/6.15; 38/102, 102.2, 102.91

[56] References Cited

U.S. PATENT DOCUMENTS

| | | | |
|---|---|---|---|
| 1,298,280 | 3/1919 | Baynard | 112/43 |
| 1,776,954 | 6/1930 | Scholler | 112/43 X |
| 2,170,554 | 8/1939 | Elliott | 112/43 |
| 2,175,941 | 10/1939 | Keays | 248/363 X |
| 2,316,648 | 4/1943 | Giglio | 112/43 X |
| 3,664,288 | 5/1972 | Von Boden et al. | 112/103 |
| 4,357,885 | 11/1982 | Stockton | 112/103 |
| 4,411,208 | 10/1983 | Nishida et al. | 112/103 |
| 4,587,910 | 5/1986 | Raines | 112/121.15 X |
| 4,762,076 | 8/1988 | Wakaizumi | 112/103 |
| 4,860,467 | 8/1989 | Larson | 38/102.91 X |
| 5,386,960 | 2/1995 | O'Brien | 248/205.3 |

OTHER PUBLICATIONS

"Totally Stable Iron-On Tear Away Stabilizer"—2 pages ©1991 Sulky of America.

"Sulky Solvy Water Soluble Stabilizer"—2 pages, ©1990 Sulky of America.

"Scan it! Sew it! Show it!"—4 pages—New Home.

*Primary Examiner*—Ismael Izaguirre

*Attorney, Agent, or Firm*—Young & Thompson

[57] ABSTRACT

A method and device is provided for adhesively securing a fabric in place relative to a sewing needle and thread of a sewing machine while applying an image to the fabric. The device replaces the conventional hoop-like device and includes a place to which the fabric to be sewn is adhesively attached. A kit is provided which provides the user with all of the elements required to use the device and a lubricating device is provided for lubricating the needle and/or thread.

41 Claims, 7 Drawing Sheets

FABRIC SECURING DEVICE INCLUDING ADHESIVE AND NEEDLE LUBRICATION

BACKGROUND OF THE INVENTION

1. Field of the Invention

The present invention relates to a method and device for adhesively securing a fabric in place relative to a needle and thread of a sewing machine while applying an image to the fabric by, for example, embroidering.

2. Description of Prior Art

The conventional method of holding a fabric relative to a needle of an automatic sewing machine involves the use of a two-piece hoop assembly which pinches the fabric between an inner hoop ring and an outer hoop ring. Examples of such devices are described in U.S. Pat. No. 4,411,208 to Nishida et al. and U.S. Pat. No. 4,762,076 to Wakaizumi. Typically, the fabric and two-piece hoop are assembled and then attached to a sewing machine. For example, the assembled device may be attached to the X-Y motion head of an automatic sewing machine. The sewing machine then embroiders an image on the fabric within the border of the hoop. Several problems are encountered in such sewing operation. For example, there is a tendency to distort the fabric when it is clamped or pinched by the hoop. This is a particular problem when a delicate fabric is clamped within the conventional two-piece hoop. When a stretchable material is being clamped within the hoop there is a tendency for the material to gather. A further problem results from the need to have "drum tight" stretching of the fabric within the hoop in order to obtain a satisfactory image during embroidering or sewing. Subsequent removal of the fabric from the hoop may cause the fabric surrounding the image to pucker as tension is released. In addition, the cumbersome nature of the conventional hoop assembly makes it difficult to center the portion of the fabric upon which the image is to be embroidered or sewn. A further problem relates to fabric waste. For example, when a small fabric such as a pocket piece is to be embroidered, it must first be sewn or otherwise attached to a larger piece of fabric known as a "sacrifice" cloth. The sacrifice cloth is secured to the hoop assembly for embroidering. Subsequently, the pocket must be removed from the sacrifice cloth which is discarded. In addition to being wasteful, the use of a sacrifice cloth is time consuming.

It is known to use strips of adhesive or tape in place of the conventional sewing hoop to hold a fabric in place relative to needles of a sewing machine. For example, U.S. Pat. No. 4,357,885 to Stockton describes such an embodiment. However, the device described in Stockton, as well as the conventional hoop, does not provide any means for preventing the thread from bouncing back; i.e., being partially withdrawn from the fabric, when the needle is withdrawn during the sewing or embroidering operation. Such bounce back requires the use of more thread than is desirable. To overcome this problem it is believed to be necessary to use high thread tension which tends to cause thread breakage and undesirable machine down time. In addition, the use of an adhesive tape as described in Stockton does not prevent puckering of the fabric during sewing.

It is an object of the present invention to provide an improved method and device for adhesively securing a fabric in place relative to a needle of a sewing machine which applies an image to such fabric.

It is a further object of the present invention to provide such a method and device which does not distort the fabric or cause the fabric to gather.

Yet another object of the present invention is to provide such a method and device which does not cause the fabric to pucker.

A further object of the present invention is to provide such a method and device by means of which a fabric may readily be centered relative to a needle of a sewing machine.

Another object of the present invention is to provide such a method and device which reduces waste by eliminating the need for a sacrifice cloth.

Yet another object of the present invention is to provide such a method and device which allows the fabric to be positioned relative to a needle of a sewing machine in an expeditious manner.

A further object of the present invention is to provide such a method and device which prevents thread bounce back during the sewing or embroidering operation.

Another object of the present invention is to provide such a method and device which reduces thread breakage by allowing for a reduction in thread tension.

It is also an object of the present invention to provide a method and device which reduces the amount of thread required in an automatic sewing operation.

It is a further object of the present invention to provide a method and device which reduces the tendency for needle breakage.

Another object of the present invention is to provide a device which can be adapted to existing sewing machines for adhesively securing a fabric in place relative to a needle of a sewing machine.

A further object of the present invention is to provide such a device in kit form.

SUMMARY OF THE INVENTION

This invention achieves these and other results by providing a method and a device for securing a fabric in place relative to a needle and thread of a sewing machine while applying an image to the fabric by the needle and thread. Sewing machine as broadly referred to herein includes machines which sew or embroider or otherwise apply an image to a fabric in any other manner using a needle and thread. Sewing as broadly referred to herein includes sewing or embroidering or otherwise applying an image to a fabric in any other manner using a needle and thread. The device of the present invention comprises a plate having an opening extending through the plate, the opening being surrounded by a peripheral portion of the plate. A first material means is attached to one surface of the peripheral portion and extends into the plate opening. The first material means includes a first surface for attachment to the fabric, the first surface comprising a first adhesive. A second material means is attached to the first material means at least where the first material means extends into the plate opening. The second material means includes a second surface for attachment to the fabric. Means is provided for attaching the plate to a sewing machine so that the plate opening is in alignment with the needle. A lubricating device is provided for lubricating the needle and the thread. A kit is also provided which includes elements adapted to practice the invention.

BRIEF DESCRIPTION OF THE DRAWINGS

This invention may be clearly understood by reference to the attached drawings in which.

DESCRIPTION OF THE PREFERRED EMBODIMENT

Figure 1A:
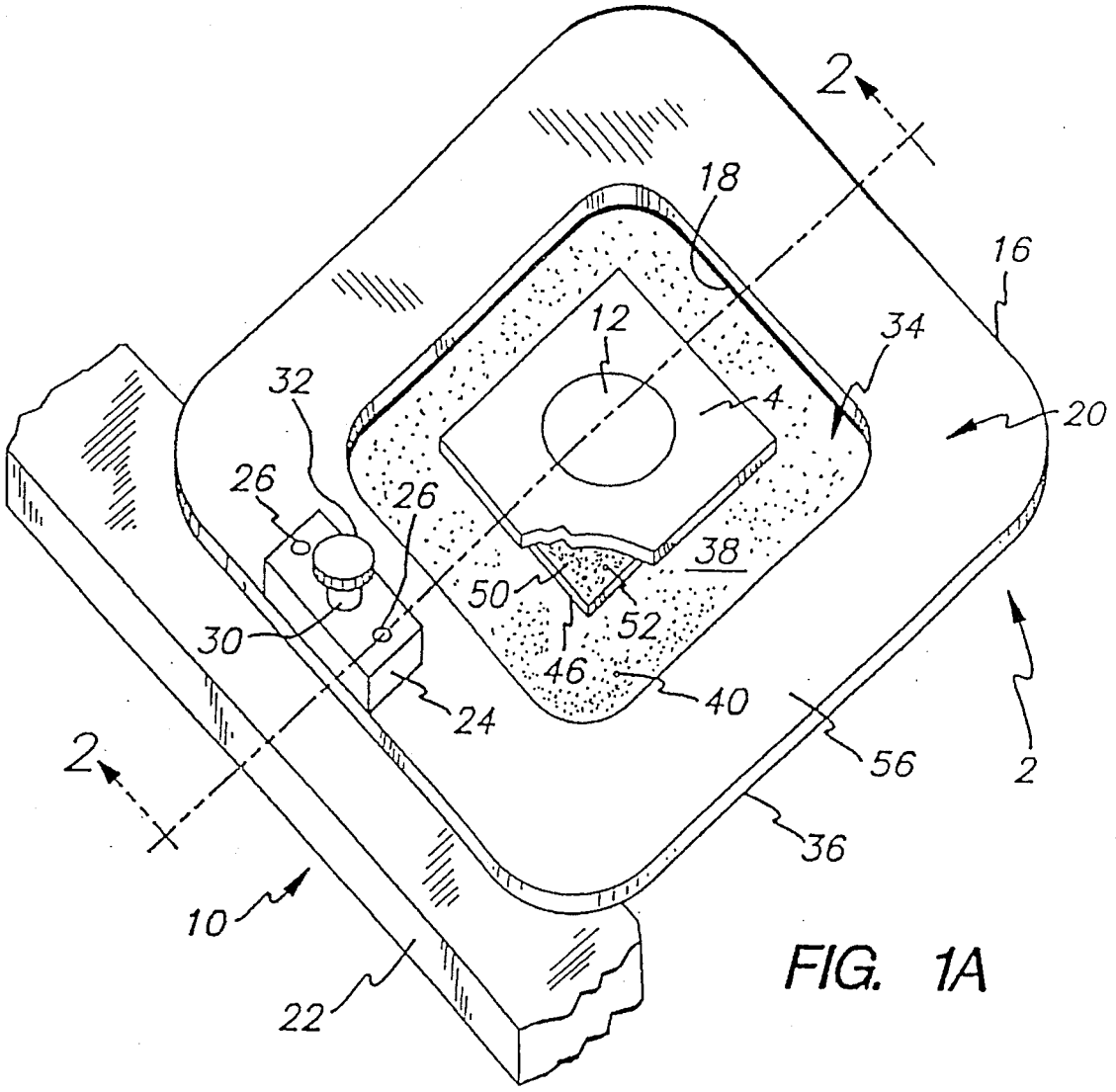
FIG. 1A is a perspective view of one embodiment of the fabric securing device of the present invention.
Figure 2:
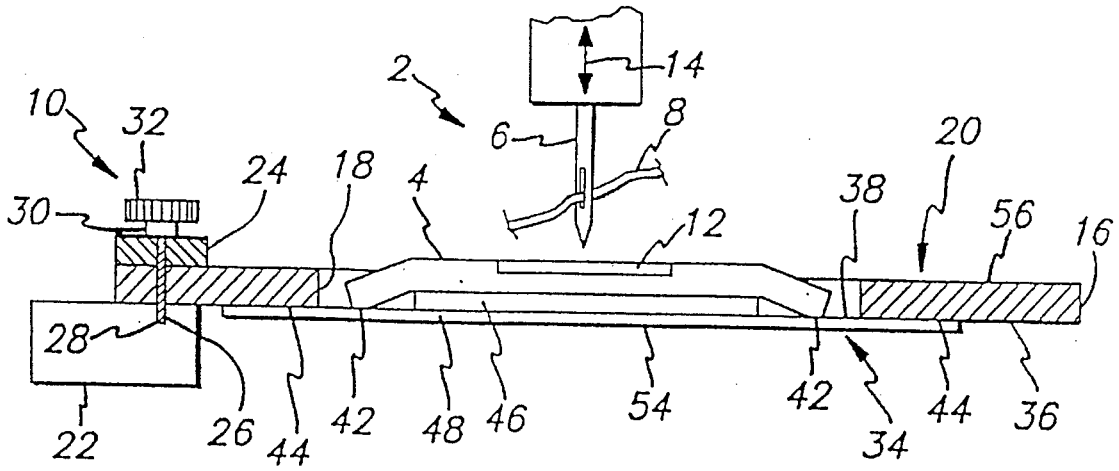
FIG. 2 is a cross-sectional view taken along lines 2—2 of FIG. 1A and further including a sewing machine needle and thread.

The embodiment which is illustrated in FIGS. 1A and 2 is one which is particularly suited for achieving the objects of this invention. FIGS. 1A and 2 depict a device 2 for securing at least one fabric 4 in place relative to a needle 6 and thread 8 of a sewing machine 10 while applying an image 12 to the fabric by the needle and thread. For example, the sewing machine 10 may be an automatic embroidery machine as described in U.S. Pat. No. 4,411,208 to Nishida et al., the needle 6 being reciprocated vertically in the direction of axis 14 to embroider the desired image 12 upon the fabric 4 in the usual manner. It will be apparent to those skilled in the art that the device 2 may be used with other types of sewing machines to accomplish the objects of the present invention.

The device 2 includes a plate 16 having at least one opening 18 extending through the plate, the opening being surrounded by a peripheral portion 20 of the plate. In the preferred embodiment, plate 16 is a flat, thin, stiff material such as tempered aluminum having a thickness of 0.8128 mm. Other materials may be used including, without limitation, high strength plastic. Means is provided for attaching the plate to a portion 22 of the sewing machine so that the opening 18 is in alignment with the needle 6. Portion 22 is representative of an X-Y motion head of an automatic sewing machine. For example, as depicted in FIGS. 1A and 2, a block 24 is attached to the plate peripheral portion 20 by means of two pins 26 each of which extends through the peripheral portion and into a respective aperture 28 of the block to properly align the plate 16 with the sewing machine portion 22 and consequently with the needle 6. The plate 16 is firmly attached to the portion 22 by means of a threaded set screw 30 the threads of which (not shown) extend through the plate and into a mating threaded aperture (not shown) in the base portion, the set screw being tightened and loosened by the head portion 32 of the set screw.

The device of the present invention includes a first material means which is attached to one surface of the peripheral portion of the plate and extends into the opening 18, the first material means having a first surface, comprising a first adhesive, for attachment to the fabric. For example, in the embodiment depicted in FIGS. 1A and 2 a first material means in the form of an adhesive tape 34 is attached to surface 36 of the peripheral portion 20 of the plate 16 and extends into the opening 18. The adhesive tape 34 includes a surface 38 which includes an adhesive 40 for attachment to the fabric 4 at 42 and to the surface 36 at 44. Without limitation, in the preferred embodiment the adhesive 40 may be a pressure sensitive adhesive.

The device of the present invention includes a second material means attached to the first material means at least where the first material means extends into the opening of the plate, the second material means having a surface for attachment to the fabric. For example, in the embodiment depicted in FIGS. 1A and 2 a second material means in the form of an adhesive tape 46 is attached to adhesive tape 34 at 48 where adhesive tape 34 extends into the opening 18 of the plate 16. Adhesive tape 46 includes a surface 50 which may be attached to fabric 4. In the preferred embodiment, surface 50 includes an adhesive 52 which may be, without limitation, a pressure sensitive adhesive.

In the embodiment of FIGS. 1A and 2, the surface 38 of the adhesive tape 34 comprises adhesive 40. In this manner the adhesive tape 34 may be attached to the bottom surface 36 of the plate 16. In an alternate embodiment, the opposite surface 54 of the adhesive tape 34 may comprise an adhesive so that the adhesive tape may be attached to the top surface 56 of the plate 16. It will be apparent to those skilled in the art that the top and/or bottom surface of tape 34 and the top and/or bottom surface of tape 46 may include an adhesive to secure the tapes to each other and to the fabric 4 and plate 16, and that the adhesive may be a pressure sensitive adhesive or any other type which will secure the parts of the device 2 together, as described herein. In a preferred embodiment, tapes 34 and 46 are acrylate pressure sensitive adhesive tape.

Figure 1B:
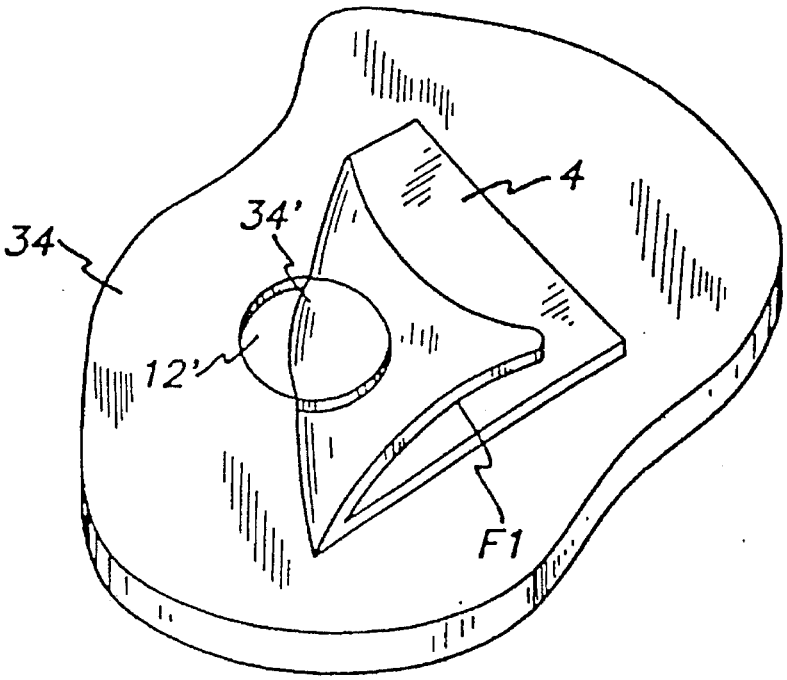
FIG. 1B depicts an embroidered fabric being removed from the embodiment of FIG. 1A after an initial use.
Figure 1C:
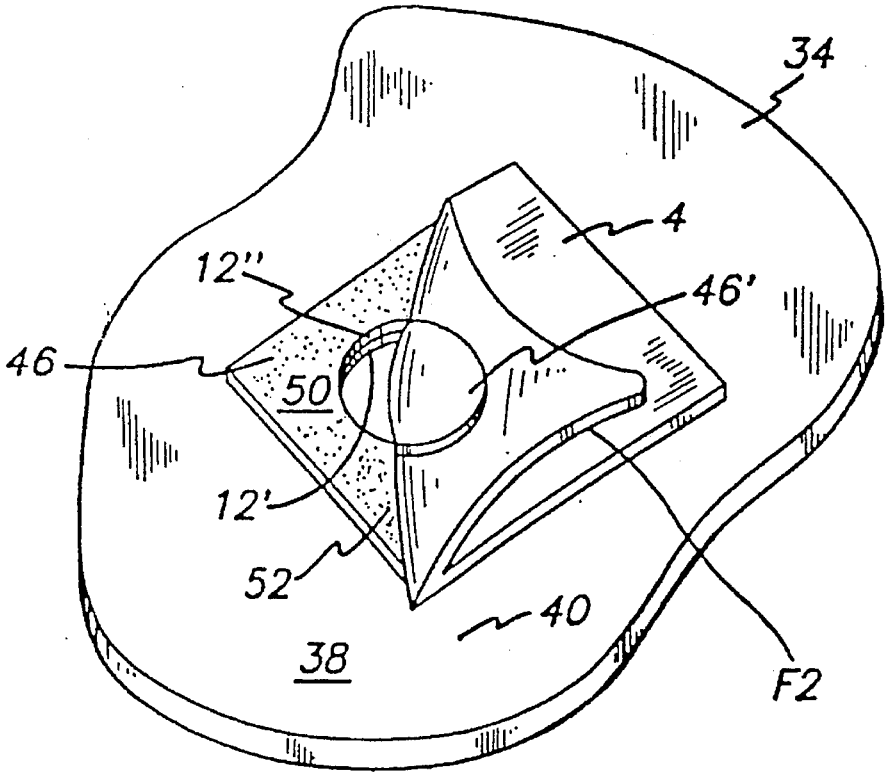
FIG. 1C depicts an embroidered fabric being removed from the embodiment of FIG. 1A after uses other than the initial use.

The device 2 of the present invention is useful in applying an image 12 upon a fabric 4 using a sewing machine 10 which includes a needle 6 and thread 8 used for applying the image to the fabric. In the process, the fabric is secured upon the plate 16 and the plate is adapted to be secured to the sewing machine so that the plate opening 18 is in alignment with the needle 6 during the sewing operation. In considering the details of the process with respect to the embodiment of FIGS. 1A and 2, when the device 2 is set up for initial use, the first material such as adhesive tape 34 is attached to a surface of the plate 16, such as surface 36, so that the adhesive tape extends into the opening 18 as depicted in FIGS. 1A and 2. In particular, in the preferred embodiment the tape 34 is adhered to surface 36 of the plate at 44 by means of adhesive 40 of tape surface 38. Preferably, the tape 34 will completely cover opening 18. The first time the device 2 is used, fabric 4 is attached only to the adhesive tape 34. Due to the use of the tape 34 there is no need for a sacrifice cloth when sewing or embroidering smaller fabrics. The fabric is merely stuck to the adhesive tape 34. In particular, in the preferred embodiment for the initial set-up, the fabric 4 is adhered to surface 38 of tape 34 by means of adhesive 40. The sewing machine is then operated by reciprocating needle 6 in the direction of arrow 14 while the plate 16 is moved in the X-Y directions in the desired pattern in the usual manner to apply the image 12 to the fabric 4, as, for example, by embroidering the image upon the fabric. In considering the initial set up, and referring to FIG. 1B, after the image has been embroidered upon the fabric 4, fabric 4 and the portion 34' of tape 34 in the shape of image 12 are removed from device 2 by, for example, peeling the portion of tape 34 in the shape of image 12 and fabric 4 from the remaining portion of tape 34 as depicted at F1. In particular, it will be apparent to those skilled in the art that the reciprocation of needle 6 will form a plurality of closely spaced apertures through the fabric 4 and tape 34 as the needle penetrates therethrough during the sewing operation. The effect of such needle penetration will be to effectively cut an opening 12' in the tape 34 the configuration of which will be the same as the configuration of the image 12. Therefore, during the initial process when the fabric 4 is peeled from the tape 34, a portion 34' of the tape 34 in the shape of image 12, which has been cut out by such needle perforation, will also be torn from tape 34 leaving a hole 12' in tape 34 having the configuration of image 12. This will have no adverse effect upon future use of the device 2. In particular, device 2 can be continuously used without replacing tape 34 even though the tape will have such a hole. As a practical matter, during the embroidering of each subsequent fabric 4 as opposed to the initial embroidering of fabric 4, the fabric and a second material such as adhesive tape 46 is attached to the adhesive tape 34 at least where the adhesive tape 34 extends into the opening 18. In particular, in the preferred embodiment for subsequent set-ups the tape 46 is adhered to surface 38 of adhesive tape 34 at 48 by means of adhesive 40. Fabric 4 is attached to the adhesive tape 34 and the adhesive tape 46. The fabric is merely stuck to the adhesive tapes 34 and 46. In particular, in the preferred embodiment the fabric 4 is adhered to surface 38 of tape 34 and to surface 50 of tape 46 by means of adhesives 40 and 52, respectively. The sewing machine is then operated by reciprocating needle 6 in the direction of arrow 14 while the plate 16 is moved in the X-Y directions in the desired pattern in the usual manner to apply the image 12 to the fabric 4, as, for example, by embroidering the image upon the fabric. As depicted in FIG. 1C, after the image has been embroidered upon the fabric the adhesive tape 46' and fabric 4 are removed from the device 2 by, for example, peeling the fabric 4 from the tape 34 which already has the hole 12' cut out by the initial embroidery in the shape of image 12, as depicted at F2. In particular it will be apparent to those skilled in the art that the reciprocation of needle 6 will form a plurality of closely spaced apertures through the fabric 4 and tape 46 as the needle penetrates therethrough during the sewing operation. The effect of such needle penetration will be to effectively re-trace the initially cut out opening in the tape 34 at 12', the configuration of which will be the same as the configuration of the image 12. Therefore, when the fabric 4 is peeled from the tape 34, a portion 46' of the tape 46 in the shape of image 12, which has been cut out by such needle perforation, will be torn from tape 46 leaving a hole 12" in tape 46 having the configuration of image 12. This will have no adverse effect upon future use of the device 2. In particular the remaining portion of tape 46 can be peeled from tape 34 and discarded. Device 2 can then be used again without replacing tape 34 even though the tape will have a hole 12' in the shape of image 12 from the initial embroidery. As a practical matter, during the embroidering of each subsequent fabric 4, the fabric and a new piece of tape 46 may be satisfactorily adhered to the portion of the tape 34 which remains after such image-shaped portion of tape 34 has been initially removed, and tape 34 will not need to be replaced until such time as the adhesive 40 on surface 38 no longer maintains its adhesive capability due to repeated use. Throughout the sewing operation the needle will penetrate through the fabric 4 and the tape 46 while the image 12 is being applied to the fabric. In this manner, the adhesive 52 of tape 46, or the adhesive 40 of tape 34 in the initial process, will tend to engage the thread and hold the thread in place to thereby prevent thread bounce back when the needle is withdrawn from the fabric. This will allow the sewing machine to be operated without applying high tension to the thread and therefore will substantially reduce thread breakage and machine down time. At the same time the quantity of thread used will be substantially reduced. A lubricant can be applied to the needle and/or thread, as described herein, while applying the image to the fabric to prevent any build-up of adhesive on the needle which might otherwise occur due to penetration of the adhesive covered tape. It has been observed that the use of the lubricant also extends the life of the needle.

After the fabric 4 and tape have been removed from the device 2, at least a portion of the tape 46, or tape 34 in the initial process, if any, may be removed from the fabric by peeling the fabric and tape apart. In some instances a portion of the tape 46, or tape 34 in the initial process, if any, will remain sewn to the fabric but since such portion will be on the underside of the fabric when viewing FIGS. 1A and 2, it will have a negligible affect upon the quality of the image 12. Similarly, any tape 46 which remains adhered to tape 34 after removal of the fabric 4 may be peeled from tape 34 to prepare the device 2 for its next use.

Figure 4:
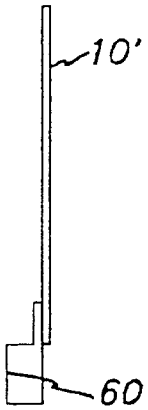
FIG. 4 is an end view of FIG. 3.
Figure 3:
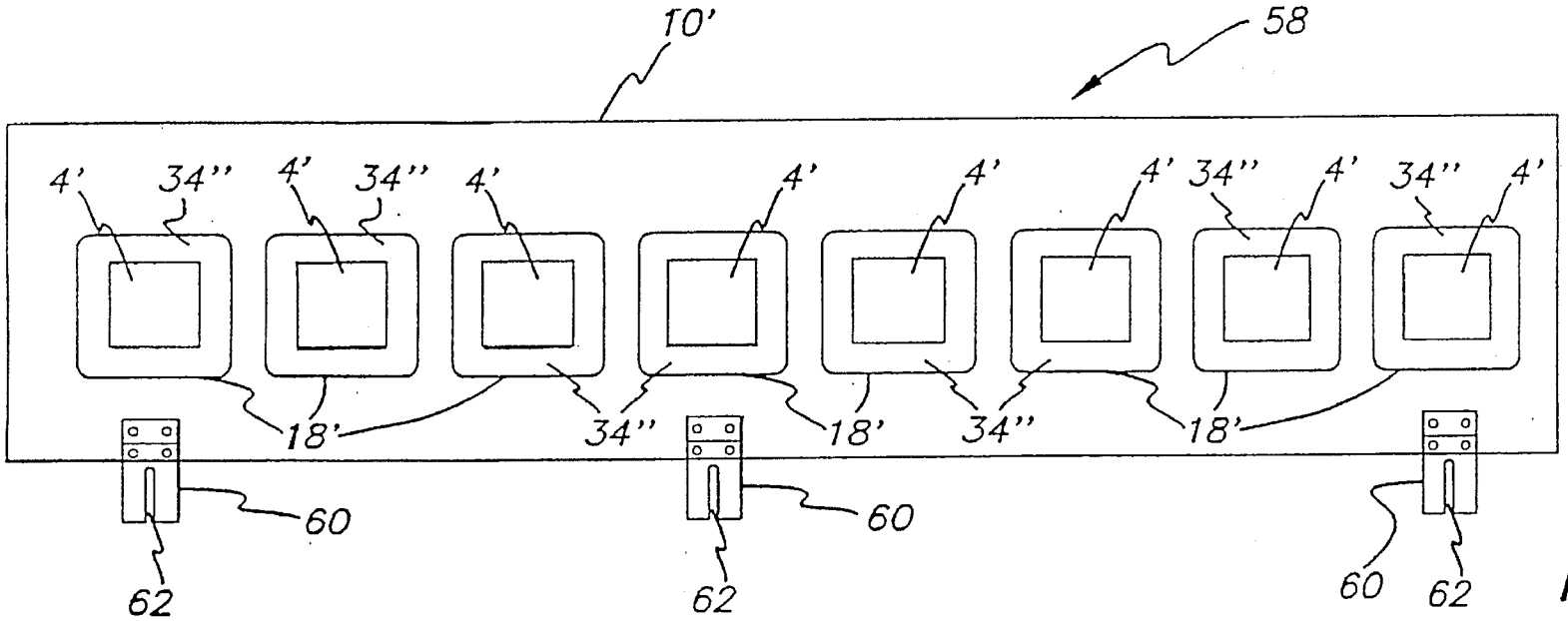
FIG. 3 is a plan view of an alternate embodiment of the present invention.

FIGS. 3 and 4 depict an alternative embodiment of the present invention. In particular, FIG. 3 depicts a device 58 for securing one or more fabrics 4' in place relative to a one or more needles and thread of a sewing machine (not shown) while applying an image to each fabric by a respective needle and thread. An example of such a sewing machine is described in U.S. Pat. No. 3,664,288 to Weidlin Von Boden et al. and U.S. Pat. No. 4,357,885 to Stockton. Device 58 includes a plate 10' having a plurality of openings 18' which extend through the plate. Each fabric 4' is adhered to an adhesive tape 34" in the same manner as described above with respect to fabric 4 and adhesive tape 34. Each fabric 4' is aligned with a respective needle such that vertical reciprocation of each needle and thread associated therewith will embroider the desired image upon each fabric 4'. Attachment means in the form of bifurcated brackets 60 are provided for securing the plate 58 to the sewing machine as required. In the embodiment depicted in FIGS. 3 and 4, set screws (not shown) extend through the openings 62 in the brackets and are threaded into corresponding threaded openings in an X-Y motion head (not shown) of the sewing machine. It will be apparent to those skilled in the art that other types of attachment means such as that depicted in FIGS. 1A and 2, or any other suitable attachment means may be used to attach the plate 58 to the sewing machine so long as the needles are properly aligned with the openings 18'.

Figure 5A:
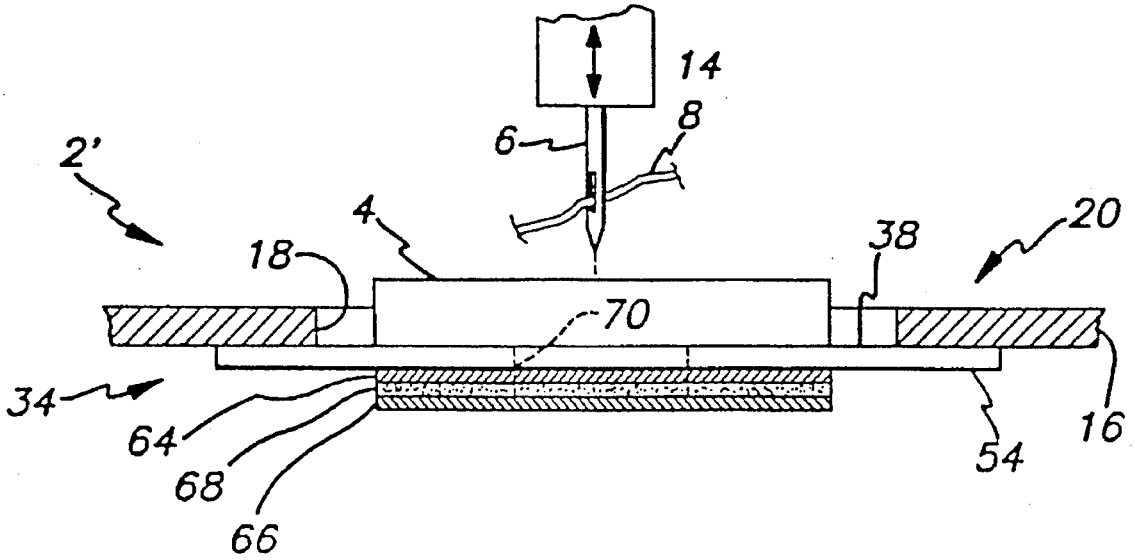
FIG. 5A is a cross-sectional view similar to FIG. 2 of another embodiment of the present invention.

FIG. 5A depicts an alterative embodiment of the present invention wherein like reference numerals designate like elements of the device 2 of FIGS. 1A and 2. The embodiment of FIG. 5A is particularly useful in embroidering knit material and is distinguishable from the embodiment of FIGS. 1A and 2 in that in the device of FIG. 5A the second material means comprises a release material 64, which is attached to surface 54 which is opposite surface 38 of the adhesive tape 34, by an adhesive means (not shown) such as a pressure sensitive adhesive. The second material means of FIG. 5A also includes a tear-away material 66 which is attached to the release material such that the release material is disposed between the adhesive tape 34 and the tear-away material. In the preferred embodiment, the tear-away material 66 is adhesively bonded to the release material 64 while at the same time selectively bonded directly to the back of fabric 4, preferably by means of a heat bond material 68, although other adhesive means may be used. The release material 64, tear-away material 66 and heat bond material 68 may comprise a silicon release paper, a non-woven fabric such as Pelon, and a heat activated film such as Pelon, respectively.

Figure 5B:
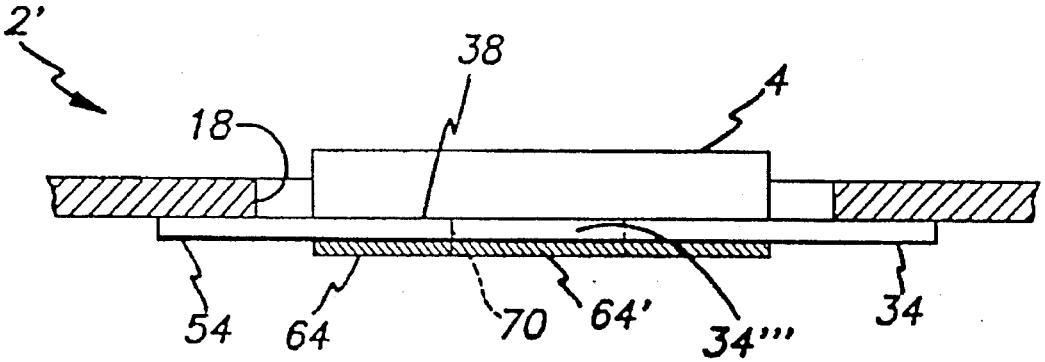
FIG. 5B depicts the embodiment of FIG. 5A during an initial use.
Figure 5C:
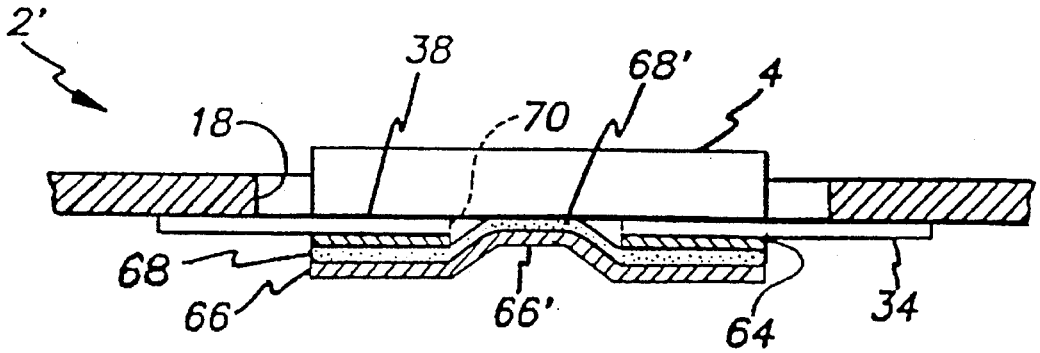
FIG. 5C depicts the embodiment of FIG. 5A during uses other than the initial use.

In the process using the device 2' of FIG. 5A in its initial use, the tape 34 is applied to completely cover opening 18 as shown in FIG. 5B. Release material 64 is adhered to surface 54 of tape 34 and a scrap piece of fabric 4 is adhered to the opposite surface 38 of tape 34. During the sewing operation, needle 6 will penetrate and perforate the tape 34 and release material 64 while sewing the image upon the fabric 4 in a manner similar to that described above regarding the embodiment of FIGS. 1A and 2. As such, during the initial process when the fabric 4 is removed from the device 2 the portions 34''' and 64' of the tape 34 and release material 64, respectively, which have been cut in the shape of the image due to the perforations, will be removed from the device as the fabric is removed thereby forming a hole 70 in tape 34 and release material 64 in the shape of image 12. In subsequent uses of the device 2, there is no need to close the holes 70 in the tape 34 and release material 64 caused by the perforations. In fact, it is desirable not to close such openings. The reason for this is that when the next fabric 4 is placed upon the surface 38 of tape 34 as depicted in FIG. 5C the tear-away material 66 will be adhered to the release material 64 and selectively to fabric 4 by means of melted heat bond material. In particular, during the heating process, which may be effected by pressing tear-away material 66 against the heat bond material 68 and release material 64 by means of a household iron typically used to iron clothing, the heat bond material will melt in the usual manner such that the heat bond material per se will become an adhesive interface 68' bonding materials 64 and 66 together and bonding material 66 permanently to fabric 4 only within the area in the shape of image 12 created by the hole 70 in tape 34. During the sewing operation, needle 6 will penetrate and perforate only the tear-away material 66 and adhesive interface 68 re-tracing the initially cutout opening 70 in tape 34 and release material 64 while sewing the image upon the fabric 4 in a manner similar to that described above regarding the embodiment of FIGS. 1A and 2. As such, when the fabric 4 is removed from the device 2' the portion 66' of the tear-away material 66 which has been cut in the shape of the image due to the perforations, will be removed from the device as the fabric is removed. This clean separation of the tear-away material from the border of image 12 on fabric 4 eliminates the uncomfortable scratchy excess backing material commonly left on conventionally embroidered images which must use a cut-away backing. In addition, the remaining portion of the tear-away material 66 may be peeled from the release material 64. For subsequent uses the next combination heat bond material 68 and tear-away material 66 are placed against the release material 64, and fabric 4 through the image hole 70 in tape 34 and release material 64, and heated. The adhesive will melt and enter the openings 70, and the tear-away material 66 will be selectively adhered to the fabric 4 as well as the release material 64. It has been observed that superior results are obtained when the fabric is adhesively bonded to the surface 38 of the tape 34 and the tear-away material 66. During subsequent sewing of the image upon the fabric 4, the needle 6 will penetrate the new piece of tear-away material 66 thereby perforating the tear-away material as described above. When the fabric is removed, the piece of tear-away material 66' in the shape of the image will also be removed. The remaining portion of the tear-away material may be peeled from the release material and the device will be ready for further use when desired.

Figure 6:
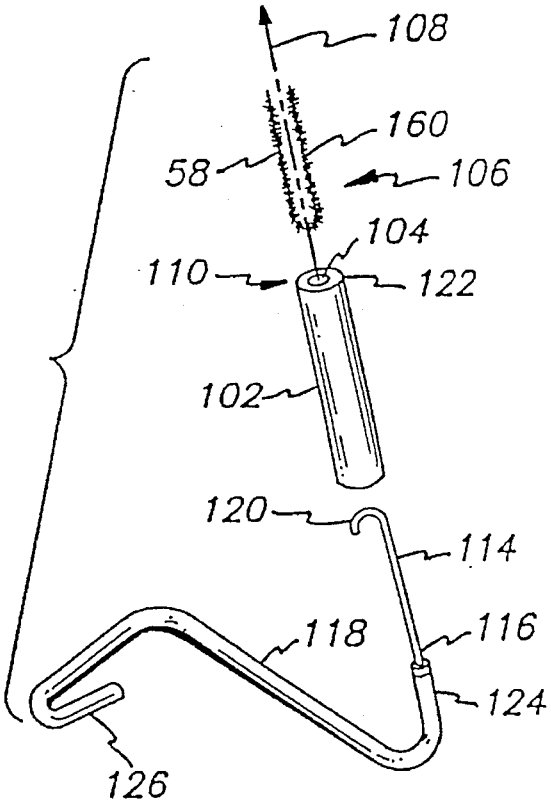
FIG. 6 is an exploded view of a portion of a lubricating device of the present invention.
Figure 7A:
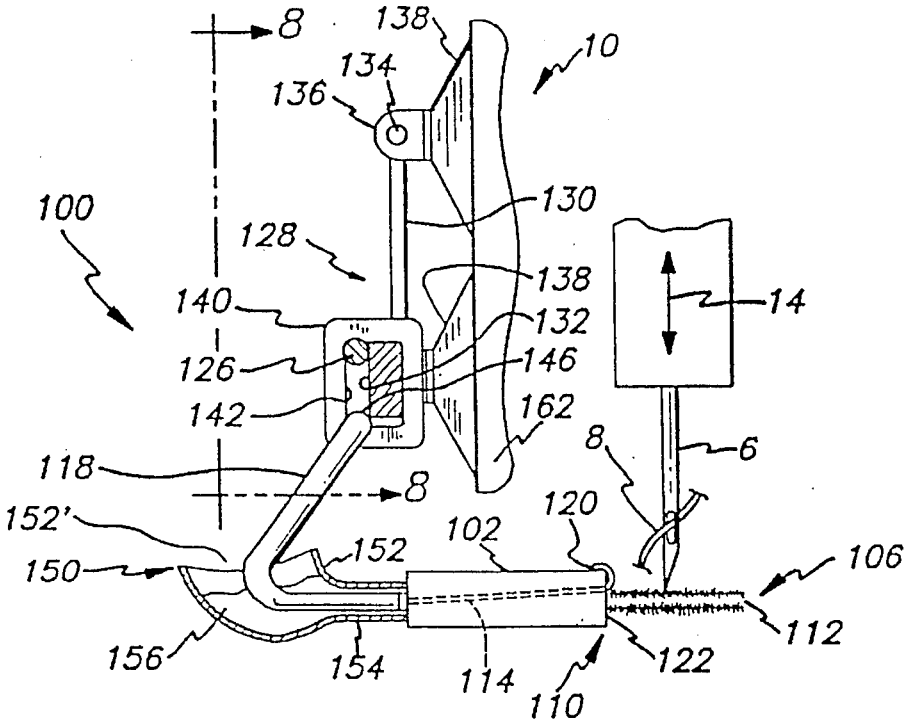
FIG. 7A is an elevational view partially in section of the lubricating device of the present invention in a lubricating mode.

In the preferred embodiment a device is provided for lubricating the sewing needle and/or thread of the sewing machine. Such device may comprise means engaging the needle and/or thread for applying a lubricant to the needle and/or thread and means adapted to be attached to the sewing machine for supporting the lubricant applying means in engagement with the needle and/or thread. In the preferred embodiment depicted in FIGS. 6 to 8, a lubricating device 100 is depicted wherein the means for applying lubricant includes a flexible and resilient tubular member 102 such as, for example, a length of latex tubing having an axially extending bore 104 and an absorbent wicking member 106 which is positioned in an axial direction 108 within the bore 104 and extends from one end 110 of the tubular member. The absorbent wicking member 106 may be a piece of conventional pipe cleaner. In use, the absorbent wicking member 106 will be wetted with a lubricant such as a silicone lubricant. A needle engaging end portion 112 of the absorbent wicking member protrudes from end 110 as depicted in FIG. 7A. In the embodiment depicted in FIGS. 6 and 7A, an elongated resilient member 114 extends in axial direction 108 within the bore 104. A first end 116 of the elongated resilient member is attached to a member 118 of a supporting means for connecting the elongated resilient member to a sewing machine, and a hooked opposite second end 120 of the elongated resilient member is attached to an edge 122 of end 110. By providing a bore 104 having a diameter which is less than the diameter of the member 118 of the attaching means, the tubular member 102 may be held in place between the member 118 and the hooked end 120. In an alternative embodiment, the member 114 may be eliminated and the tubular member 102 may be attached directly to the member 118.

Figure 9:
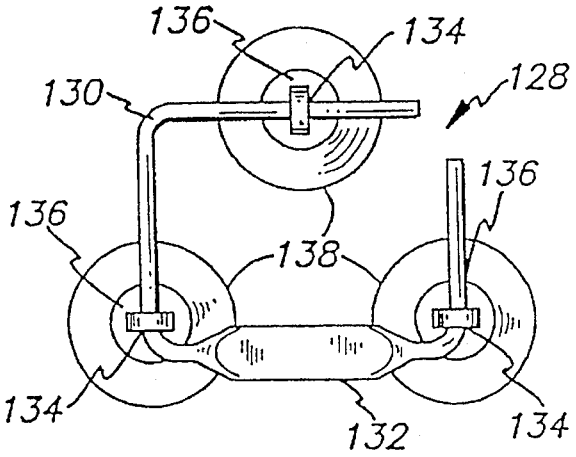
FIG. 9 is a plan view of a portion of the lubricating device of FIG. 7A.
Figure 10:
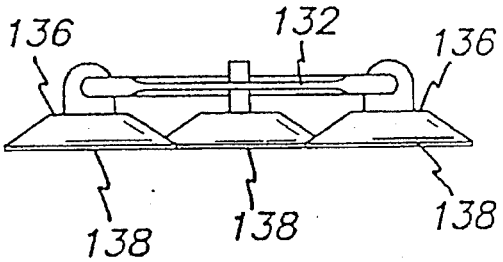
FIG. 10 is an end view of the portion of the lubricating device of FIG. 9.
Figure 8:
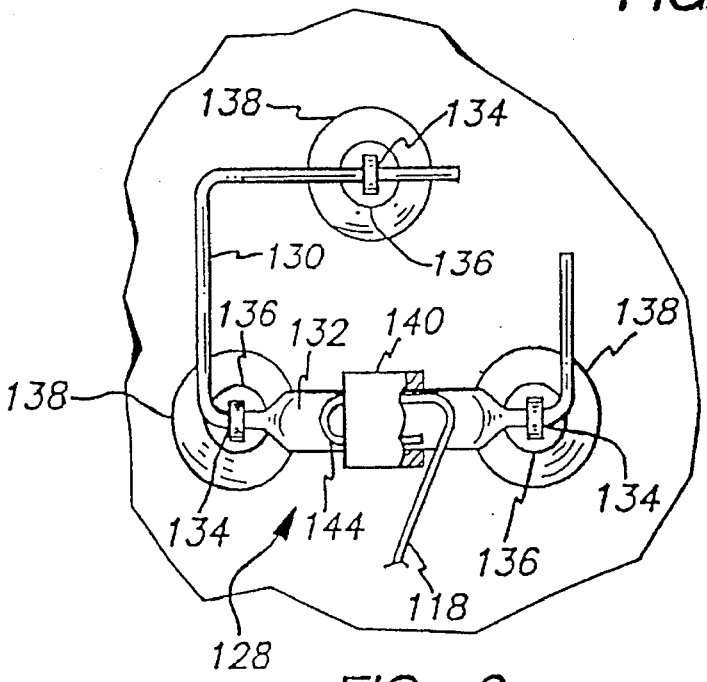
FIG. 8 is a view of FIG. 7A taken along lines 8—8.
Figure 7B:
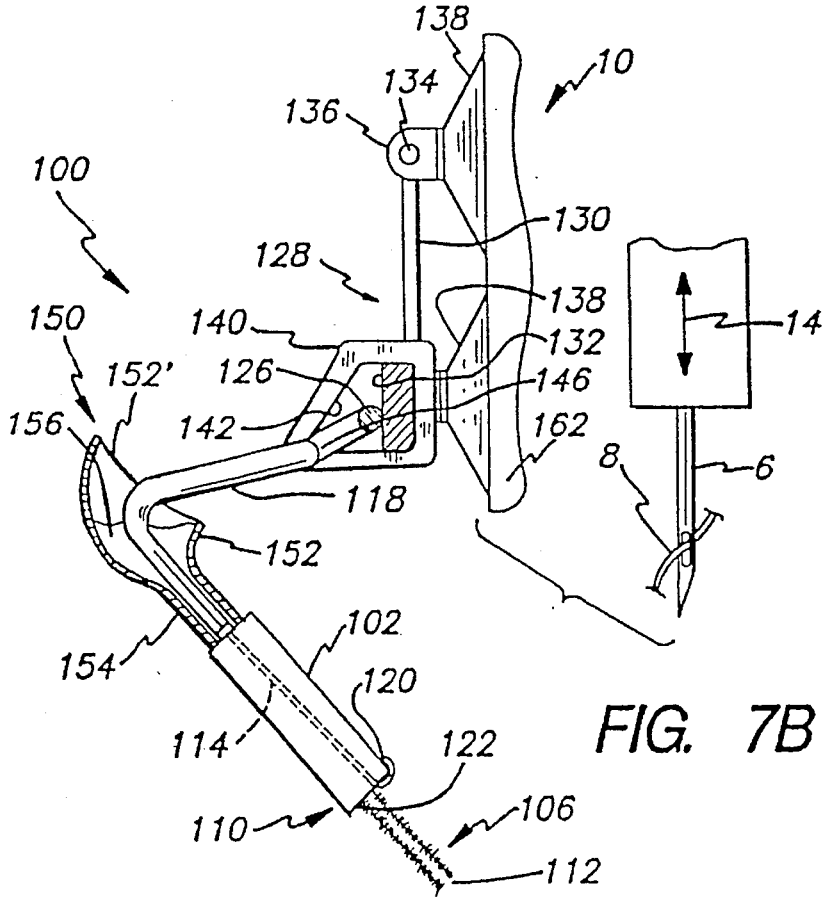
FIG. 7B is identical to FIG. 7A but depicts the lubricating device in a non-lubricating mode.
Figure 11:
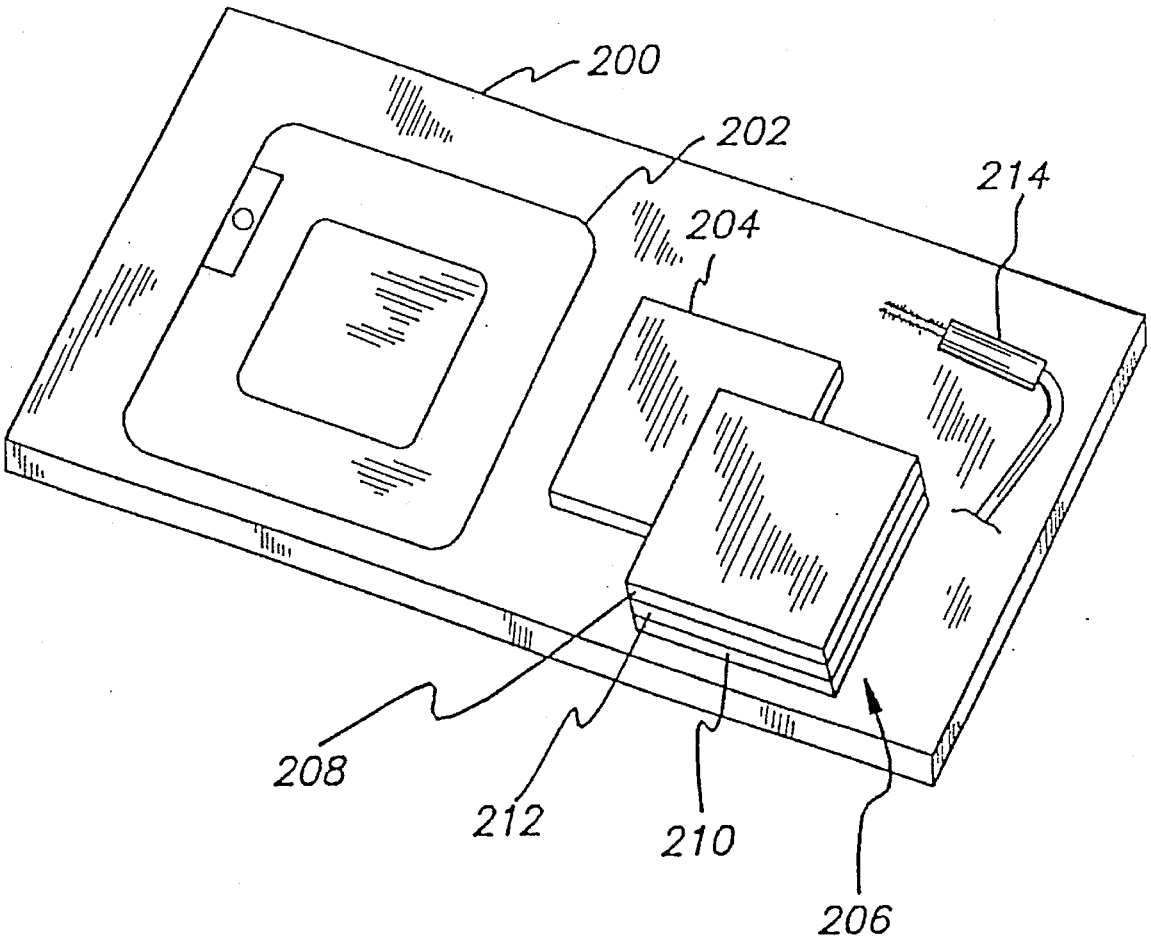
FIG. 11 is a perspective view of a kit of the present invention.

In the preferred embodiment, the member 118 of the supporting means is in the form of a wire having a first end 124 attached to the elongated resilient member 114 at its end 116, and an opposite second end 126 attached to a support member 128 which comprises at least one suction cup. In this manner, the supporting means may be attached to the sewing machine as depicted in FIG. 7A for supporting the absorbent wicking member 106 in engagement with the needle and/or thread. If desired, end 126 may be attached to support member 128 for movement of the member 118 relative to the support member 128 so that the absorbent wicking member 106 may be moved into and out of engagement of the sewing needle 6. To this end, in a preferred embodiment the support member 128 may be fabricated from a rod 130 which has been bent generally into a rectangular shape as depicted in FIGS. 8 to 10. One surface of the rod 130 has been flattened as at 132. Rod 130 extends through aperture 134 in supports 136 attached to suction cups 138 to hold the suction cups in place relative to the rod. A resilient band 140 such as, for example, an elastic latex rubber tube, encircles flat surface 132 as depicted in FIGS. 7A and 8. End 126 of the member 118 is attached to the support member 128 by being sandwiched between an inner surface 142 of the resilient band 140 and the flat surface 132. In the preferred embodiment, end 126 comprises a loop 144 having a loop portion 146 which lies in a plane which is at a first angle relative to the flat surface 132 when the applying means is in a lubricating mode, as depicted in FIG. 7A, and which is at a second angle relative to the flat surface 132 when the applying means is in a non-lubricating mode, as depicted in FIG. 7B. In the embodiment of FIG. 7A, the plane of loop surface 146 is coextensive with the flat area 132 and therefore the first angle is 0°.

In the preferred embodiment, means is provided for supplying lubricant to the lubricant applying means of the present invention. For example, in the embodiment of FIGS. 7A and 7B, a reservoir 150 is attached to an end of the flexible tubular member 102. In particular, the reservoir 150 comprises a generally cup-shaped member 152 and includes a flange 154 which extends into the bore 104 of the tubular member 102. Member 118 extends through the reservoir 150 as depicted in FIG. 7A. In such embodiment, the cup-shaped member 152 is in the form of a funnel-like device. Lubricant 156 may be inserted into the reservoir as schematically depicted in FIGS. 7A and 7B, and over time, such lubricant will wet the absorbent wicking member 106. In particular, oil will slowly flow from the cup portion 152 through the flange 154 and the tubular member 102 into the wicking member 106. The cup-shaped member 150 may be configured such that lubricant will not spill out of the top 158 of the cup-shaped member when the member 118 is pivoted as depicted in FIG. 7B to a non-lubricating position.

In the preferred embodiment, the method includes the step of applying a lubricant to the needle 6 and/or thread 8 while applying the image upon a fabric 4. This may be accomplished by attaching the lubricating device 100 to the sewing machine 10 by means of the suction cups 138 to hold the absorbent wicking member 106 in engagement with the needle 6 as depicted in FIG. 7A. By providing a bifurcated absorbent wicking member 106 which is depicted in FIG. 6 as including two legs 158 and 160, the needle 6 may be disposed between such two legs. In the preferred embodiment, the lubricant is also applied to the thread while applying the image to the fabric. For example, in the embodiment depicted in FIG. 7A, the absorbent wicking member 106 is positioned close enough to the point of the needle that as the needle reciprocates relative to portion 162 of the sewing machine in the direction of arrow 14, the thread 8 will engage the absorbent wicking member on each stroke of the needle.

A kit may be provided which provides the user with all of the elements required to practice the present invention. An example of such a kit is depicted in FIG. 8 which shows a kit 200 which includes a plate 202 similar to plate 16 and adhesive means including a first portion 204 and a second portion 206. The first portion is similar to tape 34 of FIGS. 1A and 2 and as such is adapted to be adhesively attached to one surface of the peripheral surface of the plate so that the first portion will extend into the opening in the plate as described herein with respect to plate 16 and opening 18. Like tape 34, the first portion includes a fabric engaging surface which comprises an adhesive such as, for example, a pressure sensitive adhesive. In one embodiment, the second portion 206 is similar to tape 46 of FIGS. 1A and 2 and as such is adapted to be adhesively attached to the first portion 204 at least where the first portion extends into the plate opening as described herein with respect to plate 16 and opening 18. It will be apparent to those skilled in the art that the adhesive means may be a single piece of material which the user may cut as desired to form the first portion 204 and the second portion 206. In an alternative embodiment, the second portion 206 may include a release material 208 and a tear-away material 210. Such release material 208 may be similar to release material 64 of FIG. 5A and as such be adapted to be attached to a surface of the first portion 204 opposite a fabric engaging surfacing of the first portion. Tear-away material 210 may be similar to tear-away material 66 of FIG. 5A and as such be adapted to be attached to the release material 208 to sandwich the release material between the tear-away material and the first portion 204. The kit may also include a heat bond material 212 which is similar to the heat bond material 68 of FIG. 5A and as such is adapted to bond tear-away material 210 to the release material 208 when the heat bond material is subjected to heat. The kit may also include a lubricating device 214 for lubricating the needle and/or the thread during operation of the sewing machine similar to the lubricating device 100 of FIGS. 6 to 8.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

I claim:

1. A device for securing at least one fabric in place relative to a needle and thread of a sewing machine while applying an image to said at least one fabric by said needle and thread, comprising:

a plate having at least one opening extending through said plate, said at least one opening being surrounded by a peripheral portion of said plate;

a first material means attached to one surface of said peripheral portion and extending into said at least one opening, said first material means having a first surface for attachment to said fabric, said first surface comprising a first adhesive; and means for attaching said plate to a sewing machine so that said at least one opening is in alignment with said needle.

2. The device of claim 1 wherein said first adhesive is a pressure sensitive adhesive.

3. The device of claim 1 wherein said first material means includes a surface opposite said first surface which comprises an adhesive.

4. The device of claim 1 wherein said at least one opening comprises more than one opening which extend through said plate.

5. In a method of applying an image upon a fabric using a sewing machine which includes a needle and a thread used for applying said image to said fabric and wherein said fabric is secured upon a plate having an opening extending through said plate, said plate being adapted to be secured to said sewing machine so that said opening is in alignment with said needle, wherein the improvement comprises the steps of:

attaching a first material to a surface of said plate so that said first material extends into said opening;

attaching a second material to said first material at least where said first material extends into said opening;

attaching said fabric to said first material and to said second material;

applying said image to said fabric; and removing said second material and said fabric attached to said second material from said first material.

6. The method of claim 5 further including the step of applying a lubricant to said needle while applying said image to said fabric.

7. The method of claim 5 further including the step of applying a lubricant to said needle and to said thread while applying said image to said fabric.

8. The method of claim 5 further including the step of removing at least a portion of said second material from said fabric.

9. The method of claim 5 wherein said step of attaching a second material to said first material includes the steps of securing a release material to said first material and securing a tear-away material to said release material.

10. The method of claim 5 wherein said step of attaching a second material to said first material includes the steps of securing a release material to said first material and heat bonding a tear-away material to said release material.

11. A kit for securing at least one fabric in place relative to a needle and thread of a sewing machine while applying an image to said fabric by said needle and thread, comprising:

a plate having (a) at least one opening extending through said plate, said at least one opening being surrounded by a peripheral surface of said plate and (b) connecting means secured to said peripheral surface, said connecting means being adapted to attach said plate to said sewing machine so that said at least one opening is in alignment with said needle, and adhesive means, including a first portion adapted to be adhesively attached to one surface of said peripheral surface so that said first portion extends into said at least one opening, said first portion having a fabric engaging surface which comprises an adhesive.

12. The kit of claim 11 further including means for lubricating said needle during the operation of said sewing machine, said lubricating means being adapted to be attached to said sewing machine.

13. The kit of claim 12 wherein said lubricating means is also for lubricating said thread and is adapted to be attached to said sewing machine so that said lubricating means engages said needle and said thread.

14. The kit of claim 13 wherein said adhesive means includes at least one surface which comprises a pressure sensitive adhesive.

15. A kit of claim 11 wherein said adhesive means includes at least one surface which comprises a pressure sensitive adhesive.

16. A device for lubricating at least one of a sewing needle and thread of a sewing machine, comprising:

means engaging at least one of said sewing needle and thread for applying a lubricant to at least one of said sewing needle and thread, and means adapted to be attached to said sewing machine for supporting said applying means in engagement with at least one of said needle and thread, said applying means including a flexible and resilient tubular member having an absorbent wicking member extending from one end of said tubular member, said supporting means being connected to an opposite end of said tubular member.

17. The device of claim 16 wherein said supporting means comprises a first member including a first end attached to said opposite end and an opposite second end, and a second member comprising at least one suction cup, said opposite second end being attached to said second member.

18. The device of claim 17 wherein said opposite second end is attached to said second member for movement of said first member relative to said second member.

19. The device of claim 16 further including means attached to said applying means for supplying lubricant to said applying means.

20. A device for securing one or more fabric pieces in place relative to a respective needle of a plurality of needles of a sewing machine while applying an image to each fabric piece by means of said needle, comprising:

a plate having a plurality of openings extending through said plate, each opening of said plurality of openings being surrounded by a peripheral surface of said plate;

a first material attached to one surface of a peripheral surface of at least one opening of said plurality of openings and extending into said at least one opening;

a second material adhesively attached to said first material at least where said first material extends into said at least one opening, said first material and said second material each having a fabric engaging surface which comprises an adhesive; and means for attaching said plate to said sewing machine so that said at least one opening is in alignment with a needle.

21. In a method of applying an image upon a fabric using a sewing machine which includes a needle and a thread used for applying said image to said fabric and wherein said fabric is secured upon a plate having an opening extending through said plate, said plate being adapted to be secured to said sewing machine so that said opening is in alignment with said needle, wherein the improvement comprises the steps of:

attaching a material to a surface of said plate so that said material extends into said opening;

attaching said fabric to said material;

applying said image to said fabric; and removing said fabric from said plate.

22. A kit for securing at least one fabric in place relative to a needle and thread of a sewing machine while applying an image to said fabric by said needle and thread, comprising:

a plate having (a) at least one opening extending through said plate, said at least one opening being surrounded by a peripheral surface of said plate and (b) connecting means secured to said peripheral surface, said connecting means being adapted to attach said plate to said sewing machine so that said at least one opening is in alignment with said needle, and adhesive means, including a first portion adapted to be adhesively attached to one surface of said peripheral surface so that said first portion exceeds into said at least one opening, and a second portion adapted to be adhesively attached to said first portion at least where said first portion extends into said at least one opening, said first portion having a fabric engaging surface which comprises an adhesive.

23. The kit of claim 22 wherein said second portion includes a release material adapted to be attached to a surface of said first portion opposite a fabric engaging surface, and a tear-away material adapted to be attached to said release material to sandwich said release material between said tear-away material and said first portion.

24. The kit of claim 23 further including a heat bond material adapted to bond said tear-away material to said release material when said heat bond material is subjected to heat.

25. A device for lubricating at least one of a sewing needle and thread of a sewing machine, comprising:

means engaging at least one of said sewing needle and thread for applying a lubricant to at least one of said sewing needle and thread, and means adapted to be attached to said sewing machine for supporting said applying means in engagement with at least one of said needle and thread, said applying means including a flexible and resilient tubular member having an absorbent wicking member extending from one end of said tubular member, said supporting means being connected to an opposite end of said tubular member, said supporting means comprising a first member including a first end attached to said opposite end and an opposite second end, and a second member comprising at least one suction cup, said opposite second end being attached to said second member for movement of said first member relative to said second member, and said second member comprising a flat surface and a resilient band which encircles said flat surface, said opposite end of said first member being attached to said second member by being sandwiched between an inner surface of said resilient band and said flat surface.

26. The device of claim 25 wherein said opposite end of said first member comprises a loop having a loop surface which lies in a plane which is at a first angle relative to said flat surface when said applying means is in a lubricating mode and which lies in a plane which is at a second angle relative to said flat surface when said applying means is in a non-lubricating mode.

27. The device of claim 26 further including means attached to said applying means for supplying lubricant to said applying means.

28. The device of claim 27 wherein said supplying means comprises a reservoir attached to said opposite end of said tubular member.

29. The device of claim 28 wherein said reservoir comprises a generally cup-shaped member.

30. The device of claim 29 wherein said cup-shaped member includes a flange which extends into said tubular member.

31. A device for lubricating at least one of a sewing needle and thread of a sewing machine, comprising:

means engaging at least one of said sewing needle and thread for applying a lubricant to at least one of said sewing needle and thread, said applying means including a flexible tubular member having an axially extending bore, and an absorbent wicking member which extends in an axial direction within said bore from one end of said bore, a needle engaging portion of said absorbent wicking member protruding from said one end, and means adapted to be attached to said sewing machine for supporting said applying means in engagement with at least one of said needle and thread, said supporting means including an elongated resilient member which extends in an axial direction within said bore.

32. The device of claim 31 wherein a first end of said elongated resilient member is attached to means for connecting said elongated resilient member to said sewing machine, and an opposite second end of said elongated resilient member is attached to an edge of said one end of said bore.

33. A device for securing at least one fabric in place relative to a needle and thread of a sewing machine while applying an image to said at least one fabric by said needle and thread, comprising:

a plate having at least one opening extending through said plate, said at least one opening being surrounded by a peripheral portion of said plate;

a first material means attached to one surface of said peripheral portion and extending into said at least one opening, said first material means having a first surface for attachment to said fabric, said first surface comprising a first adhesive;

a second material means attached to said first material means at least where said first material means extends into said at least one opening, said second material means having a second surface for attachment to said fabric; and means for attaching said plate to a sewing machine so that said at least one opening is in alignment with said needle.

34. The device of claim 33 wherein said second surface comprises a second adhesive.

35. The device of claim 34 wherein said second adhesive is a pressure sensitive adhesive.

36. The device of claim 33 wherein said second material means comprises a release material attached to a surface of said first material means which is opposite said first surface, and a tear-away material attached to said release material such that said release material is disposed between said first material means and said tear-away material.

37. The device of claim 36 wherein said tear-away material is adhesively bonded to said release material.

38. The device of claim 36 wherein said tear-away material is adhesively bonded to said release material by means of a heat bond material.

39. A device for securing at least one fabric in place relative to a needle and thread of a sewing machine while applying an image to said at least one fabric by said needle and thread, comprising:

a plate having at least one opening extending through said plate, said at least one opening being surrounded by a peripheral portion of said plate;

a first material means attached to one surface of said peripheral portion and completely covering said at least one opening, said first material means having a first surface for attachment to said fabric, said first surface comprising a first adhesive; and means for attaching said plate to a sewing machine so that said at least one opening is in alignment with said needle.

40. A kit for securing at least one fabric in place relative to a needle and thread of a sewing machine while applying an image to said fabric by said needle and thread, comprising:

a plate having (a) at least one opening extending through said plate, said at least one opening being surrounded by a peripheral surface of said plate and (b) connecting means secured to said peripheral surface, said connecting means being adapted to attach said plate to said sewing machine so that said at least one opening is in alignment with said needle, and adhesive means, including a first portion adapted to be adhesively attached to one surface of said peripheral surface so that said first portion completely covers said at least one opening, said first portion having a fabric engaging surface which comprises an adhesive.

41. In a method of applying an image upon a fabric using a sewing machine which includes a needle and a thread used for applying said image to said fabric and wherein said fabric is secured upon a plate having an opening extending through said plate, said plate being adapted to be secured to said sewing machine so that said opening is in alignment with said needle, wherein the improvement comprises the steps of:

attaching a material to a surface of said plate so that said material completely covers said opening;

attaching said fabric to said material;

applying said image to said fabric; and removing said fabric from said plate.

* * * * *